United States Patent [19]

Reis et al.

[11] 4,420,209

[45] Dec. 13, 1983

[54] PLUG CONTACT

[75] Inventors: Edmund Reis; Arthur Wondra, both of Erlangen, Fed. Rep. of Germany

[73] Assignee: Siemens Aktiengesellschaft, Berlin & Munich, Fed. Rep. of Germany

[21] Appl. No.: 239,053

[22] Filed: Feb. 27, 1981

[30] Foreign Application Priority Data

Mar. 28, 1980 [DE] Fed. Rep. of Germany ..... 3012239

[51] Int. Cl.[3] ..... H01R 13/627

[52] U.S. Cl. ..... 339/91 R; 339/184 M

[58] Field of Search ..... 339/184 M, 91 R

[56] References Cited

U.S. PATENT DOCUMENTS

| | | | |
|---|---|---|---|
| 3,083,274 | 3/1963 | Sparkes | 339/91 R X |
| 3,452,316 | 6/1969 | Panek et al. | 339/91 R X |
| 3,953,099 | 4/1976 | Wilson | 339/184 M X |
| 4,070,080 | 1/1978 | Eshleman et al. | 339/184 M X |
| 4,166,664 | 9/1979 | Herrmann, Jr. | 339/91 R |

FOREIGN PATENT DOCUMENTS

| | | |
|---|---|---|
| 2544025 | 4/1977 | Fed. Rep. of Germany . |
| 2144977 | 2/1973 | France . |

*Primary Examiner*—Mark Rosenbaum

*Attorney, Agent, or Firm*—Hill, Van Santen, Steadman & Simpson

[57] ABSTRACT

A plug contact assembly, comprising a female plug member and a corresponding male plug piece, is provided with an interlocking means utilizing a locking tongue member which is protected from deformation and mechanical stress within the confines of an annular surrounding socket wall. The tongue is a free-extending, resilient member having at least one detent hump formed thereon and arranged to engage into an associated detent recess formed along a generally flat base wall surface of the other plug section to establish a locking interconnection of the plug contact members. The tongue is spaced beneath an adjacent edge of a plug head portion to define therebetween a groove into which the base wall of the other associated plug section slides during interengagement of the plug members. The groove and base wall are of approximately equal heights such that a tight-fit passage of the base wall into the groove is afforded, thereby assuring proper alignment of connector pins and plug contact holes during the joining together of the male and female plug members.

9 Claims, 3 Drawing Figures

PLUG CONTACT

BACKGROUND OF THE INVENTION

1. Field of the Invention

The invention relates to a plug contact assembly comprising a female portion and a matching male section having interconnecting detent means for providing locked engagement of the male and female sections.

2. The Prior Art

Interlocking plug contact assemblies are known in the art. Typically, a tongue member is provided on the female portion for extension into a corresponding groove formed on the male plug portion. The tongue and groove are provided with a detent means which serves to frictionally interlock the male and female sections together. A significant disadvantage with the plug contact assemblies of this type is that the tongue lies exposed along a side surface portion of the female plug head and is, thus, able to overbend and deform leading to deterioration of the detent interconnection. In addition to deterioration of its locking connection, the locking members are prone to contamination leading to early wear.

The present invention is directed to a plug contact assembly whose male and feamle sections are protected against contamination and mechanical stresses leading to deformation of the interlocking members.

SUMMARY OF THE INVENTION

A plug contact assembly is provided wherein one plug section contains a longitudinally extending engagement tongue seated, along with plug contacts, in a protected space interior of an annular outer wall or sleeve member. The tongue is provided with an up-raised detent knob member to be interlocked in detent fashion with a corresponding recess area formed on an exterior facing wall surface of the counter plug piece. When the male and female plug pieces are joined together, the recess bearing wall extends interiorly of the one plug section sleeve such that the tongue rides over the recess bearing wall unit the knob and recess interengage. When the plug members are interconnected, the sleeve ends up annularly covering the innerengaging elements of the plug portions. In addition to the detent mechanism, respective groove and ridge means are provided adjacent the associated plug head and connector pin portions of the plug pieces to guide the plug members into proper alignment for interconnection.

DESCRIPTION OF THE PREFERRED EMBODIMENT

Figure 1:
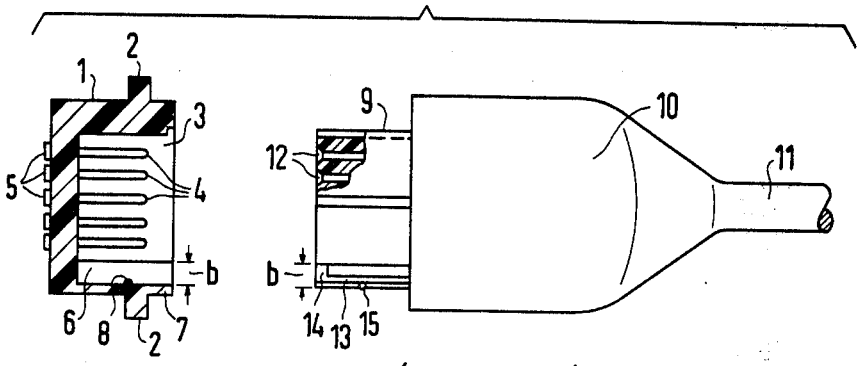
FIG 1 (PRIOR ART)
FIG. 1 is a schematic, partly broken-away cross-sectional elevational view of female and male sections of a plug contact assembly according to the prior art.

FIG. 1 illustrates a prior art plug contact assembly having a male plug section 1 formed with a socket flange wall 2 defining therein a cavity 3 in which connector pins 4 are disposed. Along a backwall surface of the socket wall 2, there are disposed device connectors

5 for forming an electrical connection with the connector pins 4. The male plug section 1 is typically a plastic molded element. The lower end sidewall surface of the socket wall 2 is in the form of a relatively thin base wall 7 above which is formed a longitudinal groove 6 which runs through the cavity 3. Projecting upward from the base wall 7 at a point approximately intermediate of the groove 6 is a detent hump or knob 8. The height of the groove is indicated by b. Across from the male section 1 is shown a female plug section 10 having a bushing or socket plug head 9. The female plug section is connected with the free end of an electrical wire or cable 11. The plug head 9 is formed with a plurality of contact holes 12 arranged to receive the connector pins 4 of the male plug piece. In front cross-section, the plug head 9 has a generally circular front cross-section which is recessed or cut off along the lower end thereof to define a longitudinally extending tongue portion 13. The tongue member 13 terminates less than the full longitudinal length of the plug head 9 at an endwall 14 and is contiguous with the bottom edge of the plug head. Approximately intermediate of the tongue 13, there is formed a locking hump 15 which extends outwardly downward from the plug head section 9. The tongue area has a height b matching the height of the male section groove 6, so that when the male and female plug sections are connected together, the tongue portion 13 extends into the groove 6 and the sections are locked together when the locking hump 15 is passed inwardly of the detent knob 8 formed on the lower base wall 7 of the male plug section 1. With this type of construction, the locking tongue portion 13 is freely exposed and, thus, not protected from undue mechanical stress or deformation and contamination wear.

Figure 2:
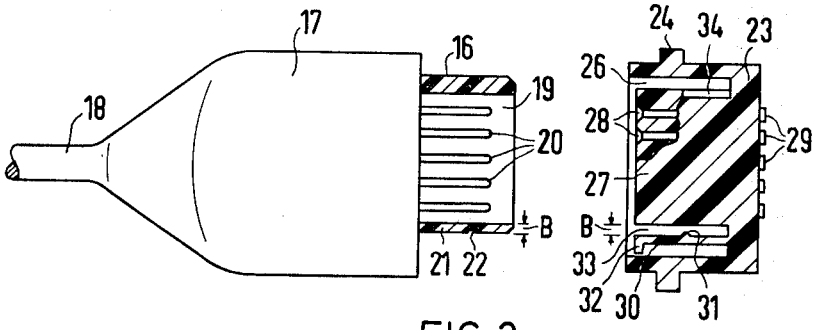
FIG. 2 is a schematic, partly cross-sectional side elevational view of male and female sections of a plug contact assembly constructed in accordance with the present invention.
Figure 3:
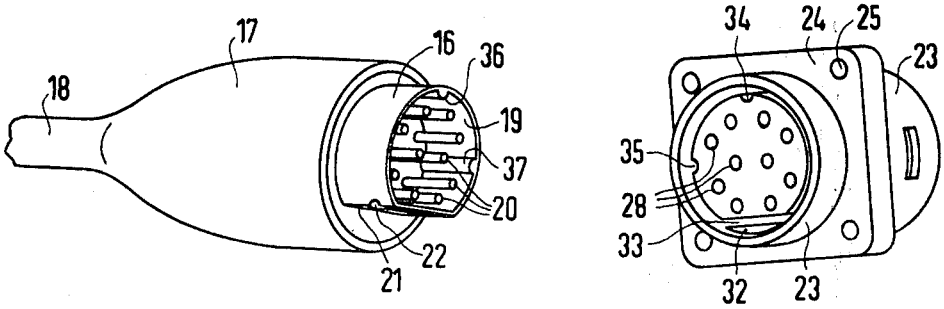
FIG. 3 is a perspective view of the male and female plug sections of the plug contact assembly of FIG. 2.

In contrast, the present invention, as illustrated in FIGS. 2 and 3, provides for means for safeguarding the structural integrity of an interconnection tongue and protects against contamination. With reference to FIGS. 2 and 3, there is shown a plug contact assembly having a male plug portion 17 formed at its lead end with a plug connector socket wall 16. For reasons discussed below, an electrical wire or cable 18 is connected with the male plug member 17. The socket wall 16 defines a cavity 19 wherein a plurality of connector pins 20 are disposed. As shown in FIG. 3, the socket 16 is generally round with a flattened or planar lower base wall portion 21 having a laterally extending exterior recess or inwardly directed notch 22. The base wall 21 has a wall thickness indicated by B.

Across from the male plug section 17 is a cooperating female plug section 23 formed with a generally annular exterior flange wall 24. The flange wall is capable of being mounted to an apparatus by means of screw or bolt assembly holes 25 formed through the flange portion of the wall 24. A space may be provided on the assembly flange wall member 24 for placement of an identification number of other such indicia. The exterior wall 24 defines an interior annular recess 26 containing a plug head 27 formed with a plurality of plug contact holes 28 for corresponding engagement therein by the connector pins 20. The plug head and exterior wall portions are in the form of a single plastic molded element.

The front cross-section of the plug contact portion 27 is generally round with a levelled off or planar bottom side surface. The planar bottom side serves as an upper surface to a slot 33 extending therebeneath having a height of B. The under-surface of the slot 33 is defined by a free-extending, integral plastic tongue 30 extending longitudinally of the plug contact 27 within the recess 26 of the annular wall 24. In this manner, the plastic tongue is protected against external interference or other forms of contamination. The tongue 30 has a detent locking hump 31 at a point approximately centrally of the tongue length and which extends upwardly into the slot 33 in the direction of the plug head 27. The outer free end of the tongue is formed with a downwardly turned abutment or stop limit wall portion 32, which serves to limit downward bending of the tongue 30 by abutting against the adjacent interior wall of the annular exterior wall 24. In this manner, a durable flexibility for the tongue 30 is maintained since the tongue is precluded from overbending. The risk of spring tension fatigue of the tongue 30 is substantially eliminated in the inventive arrangement.

When the male and female plug sections are interconnected, the socket wall 16 of the male plug member 17 extends into the recess 26 in annular spaces about the female plug head piece 27. The connector pins 20 of the male plug member are inserted into the corresponding plug contact holes 28. Simultaneously, the flattened base wall portion 21 of the male plug section 16 penetrates the slot 33 smoothly without encountering resistance or becoming misaligned since the base wall height and groove height are equal for a tight fit. As the socket wall 16 continues to be slipped over plug head 27, the tongue 30 is resiliently pressed downward until the notch 22 of the male plug section base wall 21 arrives at the location of the detent hump 31 on the tongue 30. The locking hump 31 then snaps into the associated notch 22 producing an audible snap sound so that a locking interconnection of the male and female plug sections is established. In this position, the annular wall 24 of the female plug section 23 substantially covers the socket wall 16 of the male member 17.

Thus, the present invention construction guarantees an easy plugging together capability with high locking security, due to protection of the locking tongue 30 and produces an audible snap-in sound which indicates to the user that the plug contact interconnection has been correctly established. In accordance with the preferred embodiment shown in FIGS. 2 and 3, the female plug section 23 is provided at its back wall surface with device connector portions 29 and the male plug section 17 is arranged at the lead end of the cable 18. This arrangement, unlike a typical prior art arrangement as shown in FIG. 1, provides for enhanced protection of plug contacts in case of malfunction under high voltage conditions. The plug contact assembly of the present invention is therefore, as a whole, better protected against the danger of destruction.

In addition to forming the locking connection, the flattened base wall portion 21 of the male plug head 16 and the laterally directed tight-fit groove 33 formed beneath the female plug head 27 creates a clear guideway for interconnection of the two plug sections. Nevertheless, the plug contact assembly of the present invention contains additional guiding means in the form of two longitudinal grooves 34 and 35 which extend along the exterior surface of the female plug head 27 and which are arranged to receive corresponding ridge elements 36 and 37 formed on the interior wall of the male head socket 16. It is within the contemplation of the present invention that these guideways can further be variably, individually spaced along the associated surfaces of the male and female plug sections to serve as keys to identify proper male and female plug sections for interconnection. Other guiding arrangements may be formed besides the cooperating groove and ridge mechanism, which are illustrated in FIGS. 2 and 3 as merely exemplary.

Although various minor modifications may be suggested by those versed in the art, it should be understood that we wish to embody within the scope of the patent warranted hereon all such modifications as reasonably and properly come within the scope of our contribution to the art.

I claim as my invention:

1. A plug contact assembly having a female plug section and male plug section arranged for locking interconnection, comprising a free and resilient tongue supported at one end by and extending longitudinally from a plug head associated with said female plug section and spaced from an associated planar bottom surface of said plug head to define a longitudinally directed slot, said tongue being formed with a detent hump directed towards said planar bottom surface in said slot, said female plug section having an exterior wall extending annularly spaced around said tongue and said plug head and forming an annular recess therewith, said annular recess being provided for receiving therein in interconnection a plug socket wall associated with said male plug section, said socket wall having a planar base wall, formed with an exterior recess in the outer surface thereof, for fitting into said slot, connector pin means disposed in a cavity defined by said plug socket wall, contact hole means disposed in said plug head for respectively receiving insertion of said connector pin means upon interconnection of said male and female plug sections, wherein the height of said slot substantially corresponds to the thickness of said base wall such that said tongue is biased downwardly during insertion of said base wall in said slot as said detent hump rides along said base surface until said detent hump enters said exterior recess during interconnection of said female and male plug sections.

2. The plug contact assembly of claim 1, wherein said slot is defined by said tongue and said plug head bottom surface to be laterally extending.

3. The plug contact assembly of claim 1, wherein said detent hump snaps into said recess producing an audible snap-in sound.

4. The plug contact assembly of claim 1, wherein said plug head, tongue, and exterior wall are formed of plastic molded material.

5. The plug contact assembly of claim 1, wherein said plug head is generally circular with said bottom surface being generally laterally level, said base wall is generally laterally level so as to be substantially parallel with said bottom surface, and said tongue is spaced beneath said bottom surface a distance approximately equal to the thickness of said base wall, except at said detent hump, such that said tongue is biased downwardly during the insertion of said base wall into said slot.

6. The plug contact assembly of claim 1 or 5, wherein said tongue is formed with a downturned wall portion at its free end directed toward the interior wall surface of said exterior wall for forming a limit stop support for the free end of said tongue.

7. The plug contact assembly of claim 1, wherein said exterior wall is associated with flange assembly means.

8. The plug contact assembly of claim 1, wherein said plug head and plug socket wall are formed with cooperating groove and ridge means spaced thereabout for keying the proper male and female plug sections together for interconnection.

9. The plug contact assembly of claim 1, wherein said plug head and plug socket wall are formed with cooperating groove and ridge means for guiding interconnection of said male and female plug sections.

* * * * *